United States Patent [19]

Dominick et al.

[11] 3,974,961

[45] Aug. 17, 1976

[54] DOOR LOCK FOR CASH ACCEPTANCE RECEPTACLE

[75] Inventors: George G. Dominick, Hoffman Estates; Kenneth H. Erickson, Palatine; Richard M. Price, Des Plaines, all of Ill.

[73] Assignee: Qonaar Corporation, Elk Grove Village, Ill.

[22] Filed: Apr. 18, 1975

[21] Appl. No.: 569,588

[52] U.S. Cl. ..... 232/16; 109/66

[51] Int. Cl.[2] ..... E05G 1/00

[58] Field of Search ..... 232/7, 16; 109/45, 66

[56] References Cited

UNITED STATES PATENTS

| | | | |
|---|---|---|---|
| 2,815,166 | 12/1957 | Sollenberger | 232/16 |
| 3,693,870 | 9/1972 | Dominick et al. | 232/16 |
| 3,807,628 | 4/1974 | Bock | 232/16 |
| R28,307 | 1/1975 | Dominick et al. | 232/7 |

*Primary Examiner*—Roy D. Frazier
*Assistant Examiner*—William E. Lyddane
*Attorney, Agent, or Firm*—McDougall, Hersh & Scott

[57] ABSTRACT

A collection receptacle for receiving valuables which are contained in a box having a discharge opening whereby the box can be received within the receptacle, unlocked thereby, and then moved to a position so that the valuables therein are discharged into the receptacle. The door of the receptacle carries drive means engageable with the box to achieve the movement necessary for the discharging operation. A locking arrangement comprising a movable blocking member is associated with the receptacle, and this blocking member is moved into a blocking position relative to an arm associated with the door when the driving action is commenced. The blocking member is mounted on a rod which extends to the rear of the receptacle, and a mounting plate for the box at the rear of the receptacle is operatively connected to the rod to achieve movement of the blocking member into blocking position.

6 Claims, 6 Drawing Figures

DOOR LOCK FOR CASH ACCEPTANCE RECEPTACLE

The construction of this invention comprises a collection receptacle or vault construction designed for receiving and holding cash or other valuables. The invention is particularly suited for the receipt of fares, tolls, and other fees which are accepted in large numbers from the general public by transportation systems, vending machine companies, and similar operations.

Dominick, et al. U.S. Pat. RE 28,308, issued on Jan. 21, 1975, and entitled "Cash Acceptance Receptacle," describes a construction of the type involved. As noted therein, the constructions are used in operations wherein individuals deposit cash in collection structures such as vending machines or fare collection boxes. The contents of these collection boxes must then be moved to some centralized location for counting of receipts, for deposit in banks, etc.

The collection of fares or similar payments has caused many problems, and transit systems are typical in this regard. Handling problems have been recognized particularly in the case of large transit systems where fares from many individual vehicles are received. Standard systems require handling of the fares by the operator of the vehicle in transferring the fares from the collection receptacle to coin changers or money bags. Additional handling is then required in delivering the fares to some central collection point. All of this handling takes time and, therefore, leads to additional expense. The problem is compounded where the operator of the vehicle is required to make some written account of the collection which must in turn be recorded at the central collection area.

Aside from the inefficiencies which characterize certain collection systems, there can be extreme security problems. Thus, pilferage on the part of anyone handling funds collected is extremely difficult to prevent, and a wide variety of techniques have been developed for cheating existing fare collection systems. The techniques involve mechanical alterations of the fare box structures thereby avoiding recording of the fares by counting mechanisms associated with the fare boxes. Such alterations may comprise, for example, the inclusion of means which divert coins deposited. In other cases, where the operator is required to handle deposits, schemes are devised which result in improper recording of amounts collected.

Robbery also constitutes a very severe problem in some systems requiring fare collection. A bus driver, for example, is extremely vulnerable to robbery since in a matter of seconds, a robber can enter the bus and take the driver's coin changer and money bags. Since buses operate at night —often in remote locations— it is virtually impossible to adequately protect against such occurrences when certain collection systems are used.

Because of the various problems referred to, transit authorities have reverted to "exact fare" collections. In such a system, passengers deposit money in a collection box; however, the driver is not required to carry any change, and the money is never removed from the collection box by the driver. Accordingly, the passenger must have the exact fare in his possession or must deposit an excess amount. The most that such systems require of the driver is that a receipt be given for any excess amount deposited in which case the passenger can obtain a refund at some specified location.

Since the driver does not carry any cash for change and is not authorized to personally accept any fares, the temptation to rob the driver is removed. It is, however, desirable to provide a collection system which is otherwise characterized by efficient operation and which includes mechanisms and a mode of operation which will discourage pilfering and schemes for cheating the system.

Dominick, et al. U.S. Pat. No. Re: 28,307, issued on Jan. 21, 1975, and entitled "Exact Fare System" describes mechanisms which are particularly suitable for the handling of "exact fare" collections. As explained in that application, a cash box is removably mounted in a fare box, and all deposits made in the fare box are automatically delivered to the cash box. When the cash box is removed, it is automatically secured against unauthorized entry. Specifically, a movable wall system of the cash box provides for automatic blocking of the discharge opening of the cash box in the course of the removal operation. This same cash box arrangement can, of course, be employed in various systems other than transit systems, that is, wherever cash or other valuables are collected and are to be secured against unauthorized removal.

In a typical operation, each cash box is brought to a central collection area whereby the contents of the cash box can be located in a vault in an authorized fashion. It is, of course, important to provide security at this time in order to prevent pilfering or any malfunctioning of the collection arrangement.

Dominick, et al. U.S. Pat. No. Re. 28,308 describes a collection receptacle or vault construction whereby valuables can be transferred from cash boxes without the danger of loss of such valuables. The collection receptacle operates in a highly efficient manner whereby secure but rapid transfer of valuables from a cash box to a collection receptacle can be accomplished.

It is a general object of this invention to provide a construction comprising a vault or similar cash acceptance receptacle which is characterized by improvements when compared with the construction described in U.S. Pat. No. Re. 28,308.

It is a more specific object of this invention to provide a construction of the type described wherein highly reliable and efficiently manufactured security features are included for preventing access to valuables in the construction.

These and other objects of this invention will appear hereinafter, and for purposes of illustration but not of limitation, specific embodiments of the invention are shown in the accompanying drawings in which.

Figure 1:
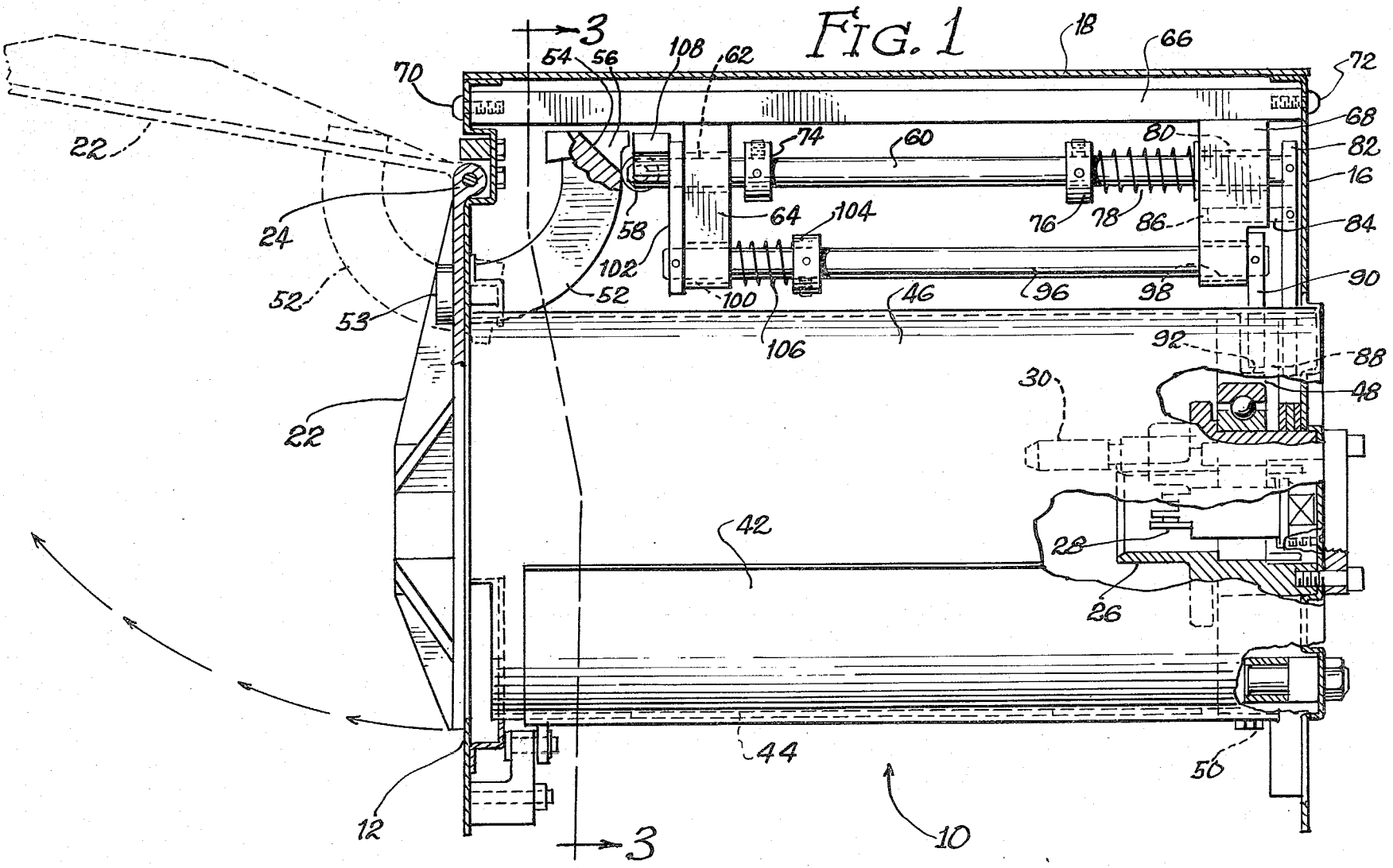
FIG. 1 is a side elevation, partly cut away, illustrating the cash acceptance receptacle of the invention.

This invention generally relates to a collection receptacle or vault construction for receiving valuables from a box in which the valuables were deposited. The collection receptacle of the invention is designed for use with boxes of the type defining a discharge opening and having a movable wall which normally covers the discharge opening. The movable wall is secured under normal conditions so that unauthorized access to the box is avoided.

The collection receptacle of this invention includes a receiving area for the box containing cash or other valuables. The door of the collection receptacle is provided with means for engaging the cash box when the door is closed. An actuating means for these engaging means is provided so that discharge of the contents of the cash box can be accomplished after the door is closed.

In the preferred form of this invention, the door of the collection receptacle includes a rotatable drive disc for engaging the cash box when the door is closed. A handle is located on the outside of the door for rotating the disc whereby relative movement of the cash box walls can be accomplished to thereby open the cash box discharge opening, and to thereby discharge the contents of the cash box into the vault area of the construction.

As shown in said U.S. Pat. No. Re. 28,308, locking mechanisms are provided which prevent access to the vault area which receives the valuables discharged from cash boxes. The particular improvement of the invention, when compared with U.S, Pat. No. Re. 28,308, relates to an additional locking means for the receptacle door. As shown in said patent, the door includes an arcuately shaped arm which moves into and out of the receptacle as the door is closed and opened. This arm functions to drive a rod rearwardly. This rod carries a locking arm which normally prevents movement of a mounting plate. The mounting plate is designed to support the box containing the valuables, and the combination of elements operates in a manner such that the door must be closed before the locking arm is moved to release the plate.

In accordance with this invention, a second rod is employed, and this rod carries a blocking member adapted to move into the path of movement of the arm associated with the receptacle door. This rod also includes a lever which is engageable with the mounting plate for the box. When the mounting plate is rotated to commence a discharge operation, the plate engages the lever to thereby move the blocking member into the path of movement of the arm associated with the door. By inter-relating the discharge action with the door operation, there is insurance against opening of the door at any time during the discharge operation. This, of course, further protects the valuables which are being transferred from the box into the receptacle.

The drawings illustrate an example of the application of the invention with the collection receptacle being generally designated by the numeral 10. This receptacle includes a front wall 12 defining an opening through which a cash box 14 (FIG. 6) can be received within the construction. The receptacle is secured against entry except through this opening since back wall 16, top wall 18 and side wall 20 are free of any openings.

Access through the opening of the receptacle is controlled by means of door 22. This door is hinged to the front wall 12 along its top edge at 24. As best shown in FIG. 1, the door, therefore, swings upwardly when a cash box is to be inserted or removed.

A lock structure 26 is mounted on the back wall 16 of the receptacle, this lock structure including a key 28 and a locating pin 30. It will be appreciated that with respect to the cash box design and its operation, reference should be made to the aforementioned U.S. Pat. No. Re. 28,308, and disclosures referred to therein. Neither the cash box structure nor the lock structure form any part of this invention.

Figure 3:
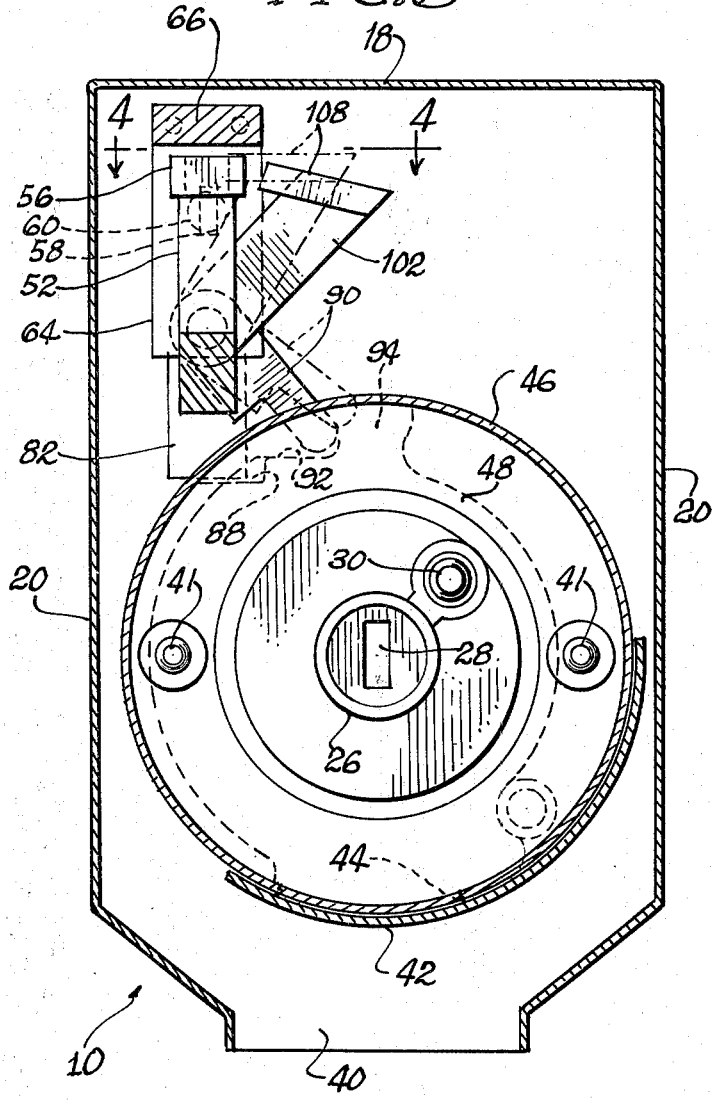
FIG. 3 is a vertical, sectional view of the receptacle taken about the line 3—3 of FIG. 1.
Figure 4:
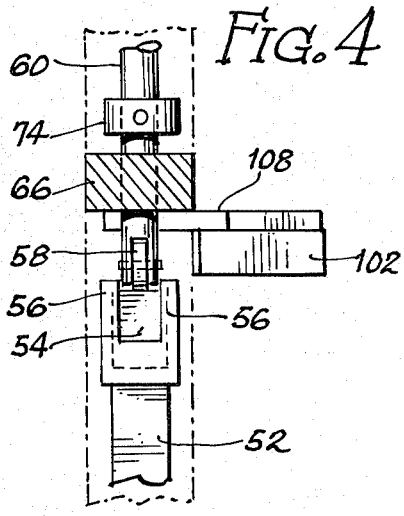
FIG. 4 is a fragmentary, cross-sectional view taken about the line 4—4 of FIG. 3.
Figure 5:
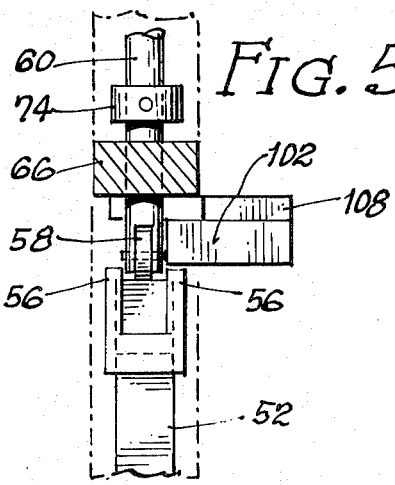
FIG. 5 is a fragmentary, cross-sectional view illustrating the structure shown in FIG. 4 in the locked position and, FIG. 6 is a rear view of the cash box construction utilized in the receptacle.
Figure 6:
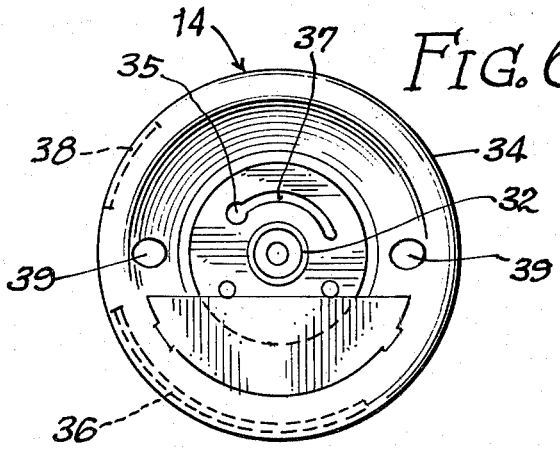

The cash box is provided with a lock 32 which normally holds the inner shell against rotation relative to outer shell 34. As shown in FIG. 6, an opening 36 is defined by the inner shell, and an opening 38 is defined by the outer shell. Openings 39 receive pins 41 (FIG. 3) to insure alignment of the box, and enlarged end 35 of slot 37 receives pin 30. When the box is unlocked and rotated, the openings 36 and 38 are brought into alignment whereby the contents of the box will drop downwardly into the receptacle. As shown in FIG. 3, the receptacle defines a receiving area 40 which will, of course, direct the valuables to an attached vault or similar construction.

Again, as described in U.S. Pat. No. Re. 28,308, the box rotation is achieved by means of drive means associated with the door 22, an opening 23 being provided for an appropriate turning handle. The drive means also achieve rotation of a shutter plate 42 which normally closes a bottom opening 44 defined by cylindrical housing 46 located within the receptacle. This housing 46 is dimensioned for receipt of the cash box. A plate 48 functions as a mounting plate for the cash box, and this plate is rotated with the cash box. The shutter 42 is tied to the plate 48 by means of fasteners 50 whereby the shutter automatically moves when the cash box is rotated.

Figure 2:
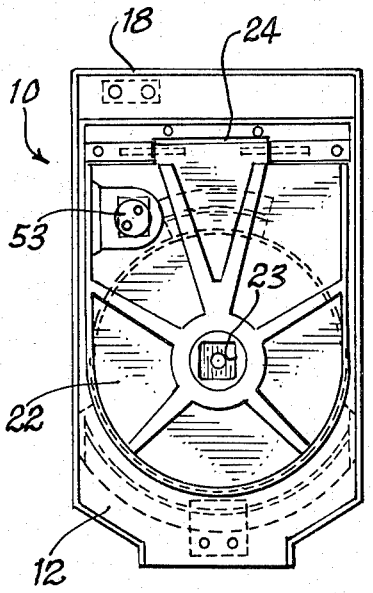
FIG. 2 is a front elevation of the receptacle.

The door 22 carries an arcuately shaped arm 52 which is attached in the position shown at 53 in FIG. 2. As shown in FIG. 1, this arm moves out of the receptacle when the door is swung to the open position and moves into the receptacle when the door is closed. The arm defines a sloped surface 54 between opposed end portions 56.

The surface 54 serves as a camming surface relative to the roller 58 which is carried at the end of rod 60. The rod 60 is slideable within a bore 62 defined by a first block 64 mounted on the bar 66. A second block 68 is attached to the bar 66 adjacent the rear wall 16 of the receptacle. The bar is secured to the receptacle by means of fasteners 70 and 72 which extend through the front and rear walls, respectively, of the receptacle.

A first adjustable collar 74 is attached to the rod 60, and the spacing between this collar and the block 64 determines the forwardmost position of the rod. A second adjustable collar 76 is positioned on the rod, and a compression spring 78 extends between this collar and the block 68. The rod is, therefore, normally pushed forwardly whereby the collar 74 normally bears against the block 64.

The block 68 defines a bore 80 which receives the rod 60. A locking arm 82 is secured to the rod on the rear side of the block 68, and this arm shifts between the position shown in FIG. 1 to a position in engagement with the rear face of block 68. The latter position is assumed when the roller 58 is out of engagement with the arm 52, that is, when the door is fully or partially opened. A pin 84 is also attached to the arm 82, and this pin is movable within an opening 86 defined by the block 68 thereby accurately positioning the arm 82 at all times.

The arm 82 cooperates with the plate 48 which serves as a mounting plate for the cash box. As previously noted, the plate 48 is designed to rotate with the cash box when the box is being moved to achieve opening thereof for the discharge of valuables.

The plate 48 defines a recess 88 which is adapted to receive the end of arm 82. As best shown in FIG. 3, the plate cannot rotate when the arm 82 is in the forward position since this arm will necessarily interfere with movement of the plate by reason of its receipt within the recess 88.

As indicated, when the arm 82 is moved out of the recess 88 due to the action of arm 52, the plate 48 is free for rotation. A second arm 90 is located adjacent the arm 82, and this second arm is received within a cut-out 92 defined by the plate. More specifically, a shoulder is defined by the plate in this area, this shoulder or cut-out comprising a horizontally disposed surface and a vertically disposed surface, the latter being formed by the protrusion 94 formed in the plate.

The second arm 90 is attached to a second rod 96 which is received within a second opening 98 defined by block 68 and also within a second opening 100 defined by block 64. A blocking member 102 is tied to the forward end of the rod 96. An adjustable collar 104 is attached to the rod, and a torsion spring 106 is interposed between the collar and block 64 and is tied thereto whereby force is applied in a counterclockwise direction to the rod 96. The spring is thus preloaded to press arm 90 against the vertically disposed surface of cut-out 92 and, when rotation of the plate 48 commences, to rotate rod 96 and thus move blocking member 102.

As best illustrated in FIG. 3, the blocking member defines a forwardly extending section 108. This extension normally assumes the solid line position of FIG. 3, and it is, therefore, normally out of the path of movement of the door arm 52. When the plate 48 is rotated clockwise, however, for purposes of achieving a discharge operation, the second arm 90 tied to rod 96 is pivoted to the dotted line position shown in FIG. 3 in response to the action of spring 106. This results in movement of the section 108 of the blocking arm into the path of movement of the door arm 52. It will be apparent that an attempt to open the door at this time would be prevented because of the position of the section 108 of the blocking arm. More specifically, an outer edge portion of the door arm 52 adjacent the section 108 travels in an arc which is occupied by the section 108 so that even if one were able to otherwise release the door, the door cannot be opened.

The blocking action of member 108 takes place at the beginning of the movement of the plate 48 so that the door is secured well before any discharge. Upon reverse movement of the plate 48 after discharge, the protrusion 94 engages the arm 90 to return the section 108 to an unblocking position. This occurs at the end of the plate travel so that the door is not opened until the vault area is secured.

The structure described is of particular advantage since the position of the arm 52 is the determining factor insofar as the rotation of the plate 48 is concerned. Thus, the plate 48 must be turned to achieve a discharging operation, and this plate cannot be turned unless the unlocking arm 82 has been moved rearwardly by the door arm 52. The operation of the blocking arm 102 is also directly tied to movements of the plate 48 and the door arm 52. The structure of this invention therefore provides a direct relationship between the rotatability of the plate 48 and the position of the door 22 with the unlocking and blocking means for the respective elements being directly related to the position of these elements. A highly secure arrangement is thereby provided.

It will be understood that various changes and modifications may be made in the above described construction which provide the characteristics of this invention without departing from the spirit thereof particularly as defined in the following claims.

That which is claimed is:

1. In a collection receptacle for receiving valuables in combination with a box wherein the box includes a discharge opening whereby valuables in the box are adapted to be transferred through the opening and into the receptacle, said receptacle defining an area for receiving said box, a door for closing access to said area, and drive means for engaging said box upon closing of the door, said drive means operating to achieve discharge of said valuables into the receptacle, a rotatable plate in the receptacle, said box engaging said plate when the box is received in the receptacle area, operation of said drive means resulting in the rotation of said plate along with said box, a door arm mounted on said door, said door arm, upon closing of said door, operating to free said plate for rotation with said box, said door arm moving into a position within said receptacle when the door is closed and said door arm moving away from said position when the door is opened, the improvement comprising a locking means in said receptacle for locking said door at the commencement of operation of said drive means, said locking means including a blocking arm, a rod supporting said blocking arm at one end thereof, an actuating arm attached at the opposite end of said rod, said actuating arm engaging said plate whereby rotation of the plate moves said actuating arm and said rod to thereby move said blocking arm into the path of movement of said door arm thereby preventing opening of the door, said door arm having an arcuate path of movement as said door opens and closes, said blocking arm moving into said path of movement upon said commencement of operation of said drive means, and including a recess defined by said plate for receiving said actuating arm when said door is closed and before the commencement of operation of said drive means, rotation of said plate resulting in movement of said actuating arm out of said recess, and further resulting in rotation of said rod about its longitudinal axis to move said blocking arm into said path of movement.

2. A construction in accordance with claim 1 including a torsion spring connected to said rod for rotating the rod.

3. A construction in accordance with claim 1 including an additional rod mounted adjacent said first mentioned rod, a locking arm attached at one end of said additional rod, a second recess defined by said plate, means normally holding said locking arm in said second recess to thereby prevent rotation of said plate, and means for moving said additional rod and said locking arm to thereby move said locking arm out of said second recess when said door is closed.

4. A construction in accordance with claim 3 wherein the end of said additional rod opposite the end carrying said locking arm is positioned in the path of movement of said arm on said door, said arm on said door engaging said additional rod and moving said locking arm out of said second recess during closing movement of said door.

5. A construction in accordance with claim 4 wherein the end of said arm on said door defines an inclined camming surface, said camming surface coming into engagement with said opposite end of said additional rod at the end of the closing movement of said door.

6. A construction in accordance with claim 3 including a pair of blocks attached in spaced apart relationship on a wall of said receptacle and extending inwardly from said wall, a pair of aligned openings in the respective blocks, said rods being received in said openings.

* * * * *